US005190170A

United States Patent [19]

Steiner

[11] Patent Number: 5,190,170

[45] Date of Patent: Mar. 2, 1993

[54] CLOTHES ARM FOR HANGING UP ARTICLES OF CLOTHING

[75] Inventor: Walter Steiner, Brütten, Switzerland

[73] Assignee: Stewi AG, Winterthur, Switzerland

[21] Appl. No.: 789,978

[22] Filed: Nov. 12, 1991

[30] Foreign Application Priority Data

Nov. 16, 1990 [CH] Switzerland ..... 3646/90

[51] Int. Cl.[5] ..... A47F 5/00

[52] U.S. Cl. ..... 211/104; 211/94; 211/96

[58] Field of Search ..... 211/1.3, 96, 104, 94

[56] References Cited

U.S. PATENT DOCUMENTS

| | | | |
|---|---|---|---|
| 1,132,190 | 3/1915 | Kohout | 211/94 |
| 1,535,133 | 4/1925 | Richards | 211/104 |
| 2,587,111 | 2/1952 | Cashen | 211/1.3 |
| 3,333,711 | 8/1967 | Helmer et al. | 211/96 |
| 4,111,309 | 9/1978 | Henry | 211/104 |
| 4,767,013 | 8/1988 | Bertelli | 211/96 |
| 4,771,895 | 9/1988 | Steiner | 211/1.3 |

*Primary Examiner*—Robert W. Gibson, Jr.
*Attorney, Agent, or Firm*—Ladas & Parry

[57] ABSTRACT

The clothes arm for hanging up articles of clothing comprises several telescopically interengaging, hollow arm elements (5–11), so that it can be telescoped in space-saving manner when not in use. Clothes hooks (3) are shaped onto the arm elements (5–11). In order that the clothes hooks (3) do not limit the telescoping together, the arm elements (5–10) have longitudinally direct recesses.

21 Claims, 3 Drawing Sheets

CLOTHES ARM FOR HANGING UP ARTICLES OF CLOTHING

BACKGROUND OF THE INVENTION

The invention relates to a clothes arm for hanging up articles of clothing and which comprises several telescopically coupled together, hollow arm elements, so that it tapers towards its free end from a fixing end carrying fixing means for fixing to a wall and on which are provided several clothes hooks, distributed over its length and projecting at right angles to the arm longitudinal direction for hanging up an article of clothing or a clothes hanger.

A clothes arm for hanging up articles of clothing is appropriately fixed to a wall at a relatively high point, e.g. at head height in the same way as clothes hooks and projects vertically therefrom. As it would then take up a lot of unused space when not in use and could even constitute a hazard, a known clothes arm is constructed so as to fold outwards against the wall. It also has a narrow construction, so that the hooks of a clothes hanger can engage over it and several articles of clothing with clothes hangers can be hung up side by side. However, it is not suitable for hanging up several articles of clothing by their hanging loops, because it is too thick for this purpose.

The problem of the invention is to provide a clothes arm, which can easily be converted into an esthetically attractive, space-saving form and which also makes it possible to hang several articles of clothing in stable manner thereon, without requiring additional clothes hangers.

It must also be easily manufacturable from a few parts.

SUMMARY OF THE INVENTION

According to the invention this problem is solved in that the clothes hooks are shaped onto at least some of the arm elements and on at least some of the arm elements is provided at least one recess permitting the telescoping of the clothes arm and which receives a shank of the clothes hook of an adjacent arm element.

BRIEF DESCRIPTION OF THE DRAWINGS

Advantageous embodiments of the clothes arm form the subject matter of dependent claims and are described in greater detail hereinafter relative to non-limitative embodiments and the attached drawings, wherein show:

DETAILED DESCRIPTION OF THE PREFERRED EMBODIMENTS

FIGS. 1, 3, 5 and 6 show a clothes arm 1, 1', 1'' according to the invention in the telescopically extended position of use, so that it extends vertically from the wall 2 to which it is fixed by a length of e.g. 40 cm. In this position or also in a shortened, not-shown position brought about by partial telescoping articles of clothing can be hung on it, in that either a conventional clothes hanger or the hanging loop of the particular article of clothing is hung in one of the numerous clothes hooks 3, 4.

Figure 1:
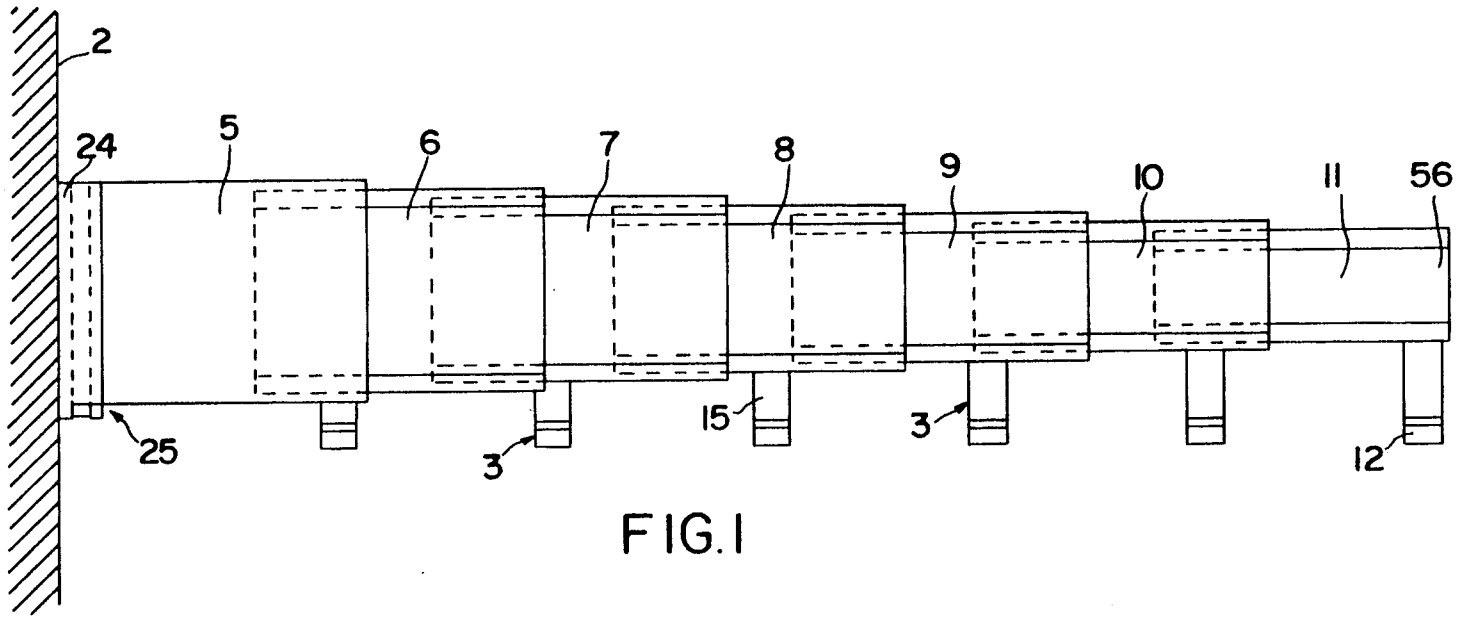
FIG. 1 A side view of a first embodiment of a clothes arm fixed to a wall.

In the embodiment according to FIG. 1 the clothes hooks 3 are shaped onto the underside of the clothes arm 1 and in each case on one of the telescopically interengaged arm elements 5 to 11 and are constructed in T-shape as double hooks with two hook parts 12 and 13.

In the embodiment according to FIGS. 3 and 4 once again a clothes hook 4 is provided one each arm element 5' to 11', but the hooks project horizontally away from a lateral surface of the arm element 5' to 11', so that the articles of clothing can only be hung on one side of the clothes arm 1'.

The clothes hooks 3, 4 e.g. have a shank 15, 16 shaped onto an arm element 5 to 11 or 5' to 11' and on whose outer end is mounted and fixed a hook body 17 manufactured as an injection moulding.

Figure 3:
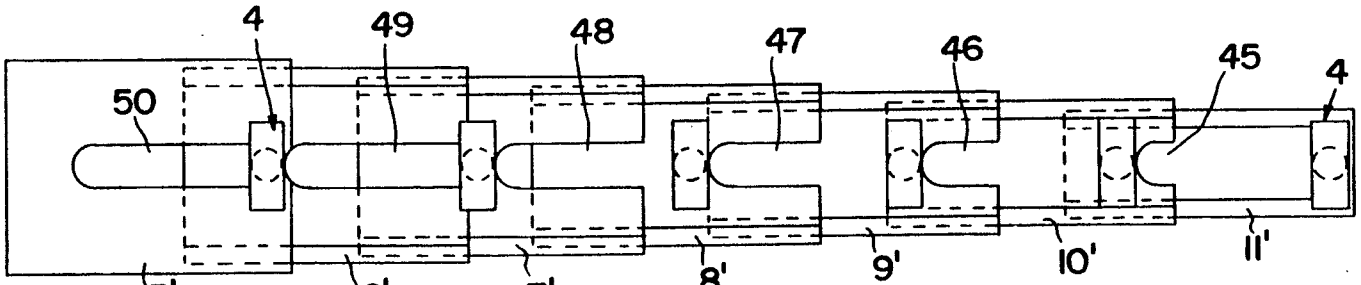
FIG. 3 A side view of a second embodiment of a clothes arm.
Figure 4:
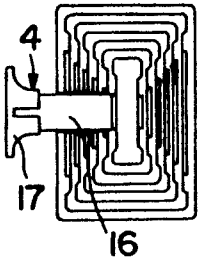
FIG. 4 An end view of the clothes arm of FIG. 3.
Figure 5:
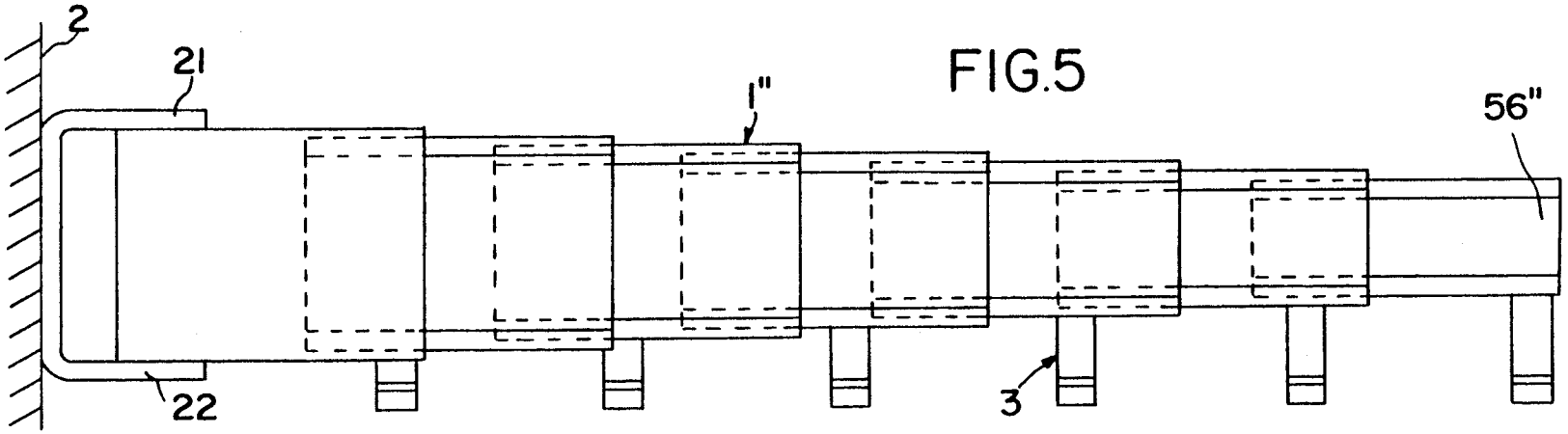
FIG. 5 A side view of a third embodiment of a clothes arm.
Figure 6:
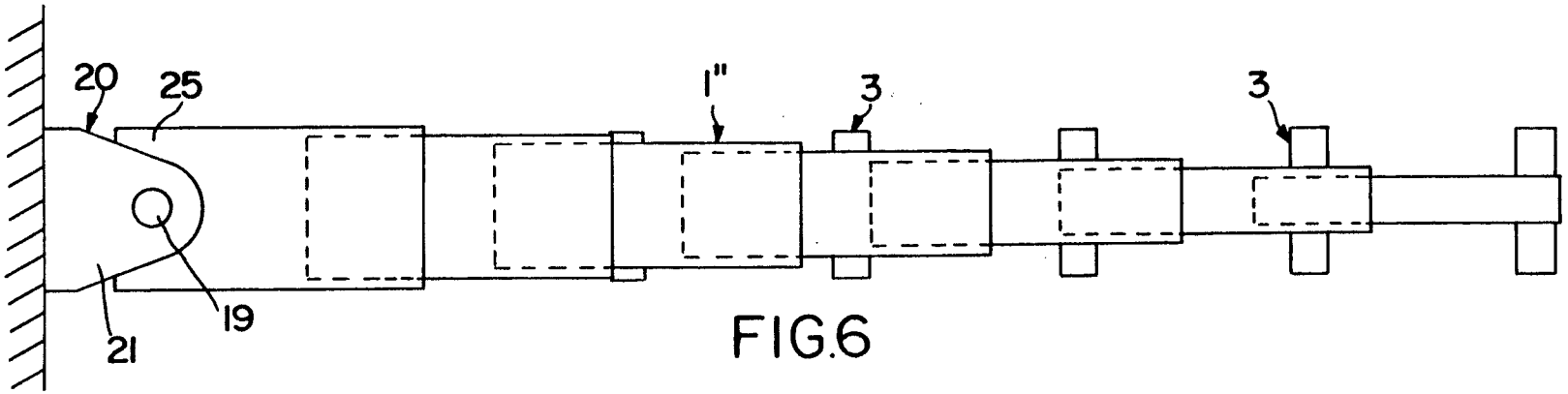
FIG. 6 A plan view of the clothes arm of FIG. 5.

In the embodiment according to FIGS. 3 and 4 with a one-sided, lateral arrangement of the clothes hooks 4, it is particularly advantageous if the clothes arm 1' is fixed so as to pivot about a vertical axis 19 in accordance with the embodiment of FIGS. 5 and 6, so that the clothes arm 1' can be pivoted into a position parallel to the wall 2 and the clothes hooks 4 in a row parallel to the wall are directed forwards away from the latter. For this purpose onto the wall 2 is screwed e.g. a U-shaped bracket part 20, whose superimposed legs 21, 22 embrace the wall-side arm element 5' or 5'' and secure the ends of the shaft 19.

Figure 2:
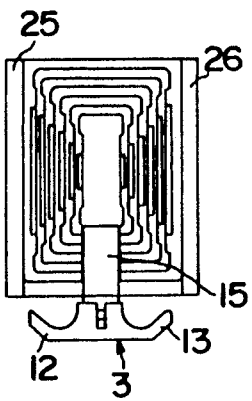
FIG. 2 An end view of the clothes arm of FIG. 1.

The embodiments of FIGS. 1, 2 and 5, 6 only differ through the construction of their fixing to the wall 2. FIGS. 1 and 2 have a wall holder 24 with vertical retaining grooves on either side and into which can be inserted from above the two lateral fixing ribs 25, 26 at the fixing end 25 of the clothes arm 1.

Figure 7:
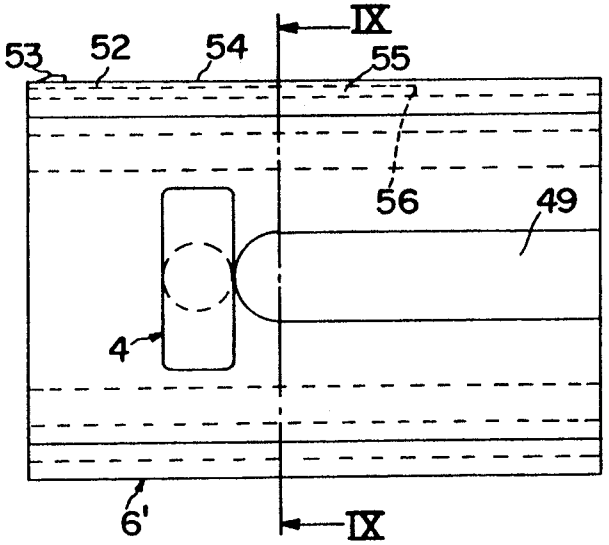
FIG. 7 A larger-scale side view of an arm element of the clothes arm of FIG. 3.
Figure 8:
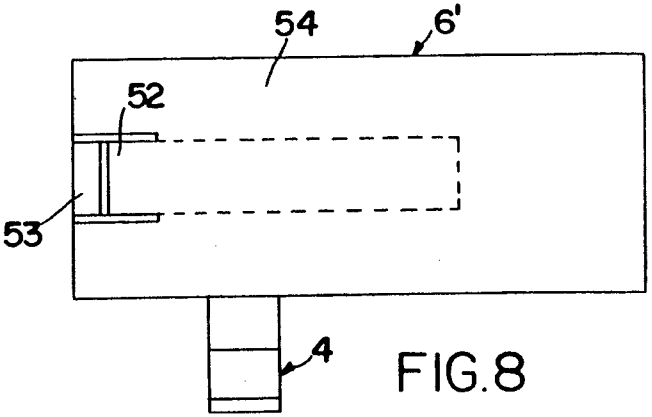
FIG. 8 A plan view of the arm element of FIG. 7.
Figure 9:
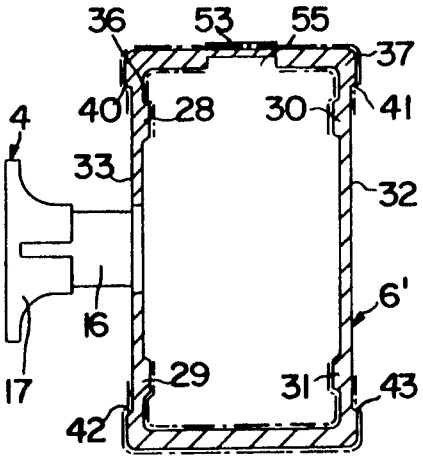
FIG. 9 A cross-section along the line IX—IX of FIG. 7.

In a larger scale compared with the other drawings and using the example of an arm element 6', FIGS. 7, 8 and 9 show a preferred construction of the arm elements 5' to 11'. The arm element 6' has an outer contour shape, which slidingly fits into the inner contour shape of the adjacent, larger arm element 5', as well as an inner contour shape into which slidingly fits the outer contour shape of the adjacent, smaller arm element 7'. These contour shapes are rectangular, the longer axis of the cross-sectional shape being vertically directed, so that the profile of the clothes arm has a considerable bending resistance.

For an easy telescoping of the arm elements 5' to 11', in order to convert the clothes arm 1' into a space-saving, compact form when not in use, said inner contour shapes are slightly profiled by four, flat inner ribs 28 to 31 on the longer rectangular sides of the hollow cross-section and the outer contour shapes have on the longer rectangular sides, wide, flat recesses 32, 33, which in each case enclose between them two of the inner ribs 28, 29; 30, 31 of the surrounding, adjacent arm element 5'. Thus, the upper, narrow lateral faces 36, 37 of the inner ribs 28, 30 form slide rails for the outer shoulder faces 40, 41, which bound the flat recesses 32, 33 of the enclosed arm part 7'. Correspondingly between the two lower, flat ribs 29, 31 and the lower shoulders 42, 43 of the flat recess 32, 33, there is a rail-like guide, which can absorb the upwardly directed forces caused by bending loads on the clothes arm 1'.

A functional rib pair 28, 29 or 30, 31 can also be replaced by a single, not shown protuberance, which has the external dimension of a rib pair and which fits with sliding clearance into the outer recess 32, 33 of the inserted, other arm part 7'.

In at least one, longer profile wall of the hollow arm part 6' is provided a slot-like recess 49, whose function will be described subsequently. Particularly if for a not shown embodiment of the clothes arm on facing sides of the arm part 6' is in each case provided such a recess 49, so as to be able to receive the facing clothes hooks, there is an interruption of the otherwise closed hollow profile of the arm part which, without the aforementioned embracing of the inner profiling 28–31 by an outer recess 32, 33 of the surrounded arm part 7', would lead to a considerably reduced bending loadability of the clothes arm. The interengaging profilings 28 to 33 bring about a stiffening of the hollow clothes arm 1, 1', apart from the improved sliding guidance.

In order to bring about the maximum telescopic sliding together of the arm parts 5 to 11 and 5' to 11', so that the distance between the clothes hooks 3, 4 can be continuously modified to zero, in the arm elements 5 to 10 and 5' to 10' is provided a slot-like recess 45 to 50 extending along a line on which are arranged the shanks 15, 16 of the clothes hooks 3, 4. The length of these recesses 45 to 50 increase in the direction of the fixing end 25, so that in the telescoped end position of the clothes arm 1, 1' the shanks 15, 16 of all the clothes hooks 3, 4 can be housed in the recess 50 of the largest arm element 5, 5'.

On the arm elements 6 to 11 and 6' to 11' are also provided resilient latching-in means, which limit the telescopic drawing apart of the clothes arm 1, 1'. They e.g. have a spring tongue 52 with a terminally shaped-on hook part 53, which at the end of the arm part projects over the upper, outer boundary surface 54, as is shown by means of the arm part 6' in FIGS. 7 and 8. On interengaging the arm parts 5 to 11 and 5' to 11' the spring tongue 52 is pressed inwards and subsequently snaps into an inside groove 55 of the surrounding arm part. The length of this groove 55 up to a shoulder 56 defines the length by which one arm part can be drawn out of the surrounding arm part, in that the hook 53 is latched onto said shoulder 55.

The free arm end 56, 56'' shown open in FIGS. 1 and 5 is preferably closed by a not shown, pressed-in cap.

What is claimed is:

1. A clothes arm for hanging articles of clothing, the clothes arm comprising:

a plurality of telescopically arranged, coupled, hollow arm elements having an axis, the arm elements having a fixing end with a fixing means whereby the arm elements can be fixed to a wall;

one or more clothes hooks distributed over the length of the arm elements and projecting at substantially right angles to the axis of the arm elements, each of the clothes hooks having a shank, the clothes hooks being arranged in a substantially straight line along the axis of the arm elements;

a recess on at least one of the arm elements for receiving the shank of the clothes hook projecting from an adjacent arm element to permit a telescoping of the clothes arm;

each of the arm elements having a closed hollow cross-section with planar boundary faces.

2. A clothes arm as claimed in claim 1 wherein the clothes hooks project laterally.

3. A clothes arm as claimed in claim 1 wherein the clothes hook projects from an underside.

4. A clothes arm as claimed in claim 3 wherein the clothes hooks are T-shaped.

5. A clothes arm as claimed in claim 1 further comprising a pivot point at the fixing end whereby the clothes arm can be pivoted into a position parallel to the wall to which it is fixed.

6. A clothes arm as claimed in claim 1 wherein the hollow cross-section of the arm elements forms a rectangle having longer sides which are vertical.

7. A clothes arm as claimed in claim 1 further comprising profiled surfaces between adjacent surfaces of the telescoping arm elements, the profiled surfaces forming inner engaging guides so that telescopic guidance takes place over shoulders defined by the profiled surfaces.

8. A clothes arm as claimed in claim 7 wherein the profiled surfaces of the arm elements are surrounded by outwardly directed profiled surfaces of an adjacent arm element.

9. A clothes arm as claimed in claim 1 wherein the arm elements are attached to each other by resilient hook, so that when the clothes arm is in an extended position the resilient hook of one arm element engages an inner shoulder of an adjacent arm element.

10. A clothes arm for hanging articles of clothing, the clothes arm comprising:

a plurality of telescopically arranged, coupled, hollow arm elements having an axis, the arm elements having a fixing end with a fixing means whereby the arm elements can be fixed to a wall;

one or more clothes hooks distributed over the length of the arm elements and projecting laterally from the clothes arm at substantially right angles to the axis of the arm elements, each of the clothes hooks having a shank, the clothes hooks being arranged in a substantially straight line along the axis of the arm elements;

a recess on at least one of the arm elements for receiving the shank of the clothes hook projecting from an adjacent arm element to permit a telescoping of the clothes arm; and the fixing end of the clothes arm having a pivotal point whereby the clothes arm can be pivoted into a position parallel to the wall to which it is fixed.

11. A clothes arm as claimed in claim 10 wherein the clothes hook projects from an underside.

12. A clothes arm as claimed in claim 10 wherein the clothes hooks are T-shaped

13. A clothes arm as claimed in claim 1 wherein each of the arm elements has a hollow cross-section forming a rectangle having longer sides which are vertical.

14. A clothes arm as claimed in claim 10 further comprising profiled surfaces between adjacent surfaces of the telescoping arm elements, the profiled surfaces forming inner engaging guides so that telescopic guidance takes place over shoulders defined by the profiled surfaces.

15. A clothes arm as claimed in claim 14 wherein the profiled surfaces of the arm elements are surrounded by outwardly directed profiled surfaces of an adjacent arm element.

16. A clothes arm as claimed in claim 10 wherein the arm elements are attached to each other by a resilient hook, so that when the clothes arm is in an extended position the resilient hook of one arm element engages an inner shoulder of an adjacent arm element.

17. A clothes arm for hanging articles of clothing, the clothes arm comprising:

a plurality of telescopically arranged, coupled, hollow arm elements having an axis, the arm elements having a fixing end with a fixing means whereby the arm elements can be fixed to a wall;

one or more clothes hooks each having a T-shape and distributed over the length of the arm elements and projecting from an underside substantially right angles to the axis of the arm elements, each of the clothes hooks having a shank, the clothes hook being arranged in a substantially straight line along the axis of the arm elements; and a recess on at least one of the arm elements for receiving the shank of the clothes hook projecting from an adjacent arm element to permit a telescoping of the clothes arm.

18. A clothes arm as claimed in claim 17 wherein the clothes hooks project laterally.

19. A clothes arm as claimed in claim 17 further comprising a pivot point at the fixing end whereby the clothes arm can be pivoted into a position parallel to the wall to which it is fixed.

20. A clothes arm as claimed in claim 17 further comprising profiled surfaces between adjacent surfaces of the telescoping arm elements, the profiled surfaces forming inner engaging guides so that telescopic guidance takes place over shoulders defined by the profiled surfaces.

21. A clothes arm as claimed in claim 17 wherein the arm elements are attached to each other by a resilient hook, so that when the clothes arm is in an extended position the resilient hook of one arm element engages an inner shoulder of an adjacent arm element.

* * * * *